US006039030A

United States Patent [19]

Robinson et al.

[11] Patent Number: 6,039,030

[45] Date of Patent: Mar. 21, 2000

[54] FUEL SYSTEM CONTAINING A SHAPE MEMORY ALLOY

[75] Inventors: Barry S. Robinson, Williamsburg; Jason T. Kilgore, Smithfield, both of Va.

[73] Assignee: Siemens Automotive Corporation, Auburn Hills, Mich.

[21] Appl. No.: 09/056,044

[22] Filed: Apr. 6, 1998

[51] Int. Cl.[7] ..... F02M 41/00

[52] U.S. Cl. ..... 123/457; 123/497; 137/79

[58] Field of Search ..... 137/79, 80; 123/457, 123/458, 497

[56] References Cited

U.S. PATENT DOCUMENTS

| | | | |
|---|---|---|---|
| 4,774,923 | 10/1988 | Hayashi . | |
| 4,790,343 | 12/1988 | Mochizuki . | |
| 4,984,542 | 1/1991 | Rische et al. . | |
| 5,226,392 | 7/1993 | Breuer et al. | 123/457 |
| 5,367,999 | 11/1994 | King et al. | 123/458 |
| 5,483,940 | 1/1996 | Namba et al. | 123/497 |
| 5,509,390 | 4/1996 | Tuckey | 123/497 |
| 5,511,519 | 4/1996 | Watson et al. . | |
| 5,558,063 | 9/1996 | Minagawa et al. | 123/457 |
| 5,603,302 | 2/1997 | Minagawa et al. . | |

*Primary Examiner*—Thomas N. Moulis

[57] ABSTRACT

A fuel or air system component for a motor vehicle, constructed with shape memory alloys, to control fuel flow as a function of temperature or electrical means. The shape memory alloy changes shape at a defined temperature, or in a particular temperature range, thereby affecting a control feature internal to a component in the fuel system, and as a result, changing the fuel flow and/or pressure characteristic. The component may be a biasing spring. The shape memory alloy is an intermetallic compound or alloy which exhibits a shape transformation when heated or cooled through its transformation temperature.

6 Claims, 6 Drawing Sheets

FUEL SYSTEM CONTAINING A SHAPE MEMORY ALLOY

BACKGROUND OF THE INVENTION

1. Field of the Invention

The present invention relates to a fuel system containing a shape memory alloy. More particularly, the present invention relates to a fuel system containing a part made from a shape memory alloy to control fuel as a function of temperature or an electrical device. The shape memory alloy will change shape at a defined temperature or in a particular temperature range thereby affecting a control feature internal to a component in the fuel system, and as a result, changing the fuel flow and/or pressure characteristic. The component may be a biasing spring.

2. Description of the Prior Art

Shape memory alloys have been used as the material for components of internal combustion engines. For example U.S. Pat. No. 5,603,302 to Minagawa et al discloses a fuel supply system for an internal combustion engine. The shape memory alloy is used to affect the sealing ability of a valve body with reference to temperature. A simple pressure relief valve is provided to reduce the effect of pressure waves transporting through the fuel system. The pressure relief valve does not function as the primary pressure control mechanism in the fuel system.

Another example is U.S. Pat. No. 4,790,343 to Mochizuki which pertains to a pressure regulator having a spring made from a shape memory alloy in the vacuum reference chamber.

U.S. Pat. No. 4,774,923 to Hayashi relates to the use of a shape memory alloy to create a two-stage pressure system. The spring made of shape memory alloy causes a regulator to regulate at a higher pressure at higher temperatures and lower pressure at lower temperatures by controlling the fuel floe through the outlet of the regulator. The regulator is a standard by-pass return type regulator.

Another system employing shape memory alloy is disclosed in U.S. Pat. No. 5,551,519 to Watson et al, in which a shape memory alloy is used to limit the actuation of an automatic choke system as a function of temperature. The air input into a fuel system is thereby controlled.

None of the foregoing references disclosed the use of a shape memory alloy component in a non-return type regulator, and none of the references discloses the use of a shape memory alloy component in a pressure regulator of a fuel system.

SUMMARY OF THE INVENTION

The foregoing and other deficiencies of the prior art are addressed by the present invention which is directed to a fuel or air system component for a motor vehicle, made with shape memory alloys, in order to control fuel flow as a function of temperature or electrical means. The shape memory alloy will change shape at a defined temperature, or in a particular temperature range, and as a result affect a control feature internal to a component in the fuel system. Consequently, a fuel flow and/or pressure characteristic will change . The component in the subsequent illustrated embodiment is a biasing spring. The shape memory alloy is an intermetallic compound or alloy which exhibits a shape transformation when heated or cooled through its transformation temperature.

The present invention utilizes shape memory alloy in spring in the inlet of a non-return type pressure regulator.

The shape memory alloy is not used to cause the regulator to regulate at two pressures, but rather to act as an on/off switch for the regulator. The shape memory alloy is used to create a secondary function within the regulator. The shape memory spring acts as a check valve/pressure relief switch within the regulator. Under a hot or cold condition, the spring actuates the valve to an open or closed position so that the fuel rail does not become under-pressurized or over-pressurized depending upon the temperature, and consequently controls the amount of vapor formation.

It is an object of the present invention to provide a fuel system with improved performance.

Another object is to provide a motor vehicle engine having a fuel system which includes a shape memory alloy in a pressure regulator.

Yet another object of the present invention is to provide a motor vehicle engine having improved fuel economy.

Still another object of the present invention is to provide a motor vehicle engine having reduced emissions.

Another object of the present invention is to provide a motor vehicle engine having greater horse power.

A further object of the present invention is to provide a motor vehicle engine having components with a longer life span.

Still another object of the present invention is to provide a motor vehicle engine having a component made of a shape memory alloy in a non-return type regulator.

DETAILED DESCRIPTION OF THE INVENTION

A shape memory alloy is defined as an intermetallic compound or alloy which exhibits a shape transformation when heated or cooled through its transformation temperature. The shape memory alloy or compound may be an intermetallic compound which exhibits two-way shape memory effect, which is defined as the ability to assume one shape below the transition temperature, and a second shape above the transition temperature.

A fuel or air system component for a motor vehicle, according to the present invention, utilizes such a shape memory alloy to control the flow of fuel as a function of temperature or in response to an electrical source. The motor vehicle can be an automobile, a watercraft, off-road vehicle or any other vehicle employing a combustion engine as a source of energy. The shape memory alloy is typically a titanium-nickel based alloy or copper based alloy, which is doped with other alloys to provide customized temperature characteristics. The shape memory alloy will change shape at a defined temperature, or within a defined temperature range, to thereby affect a control feature internal to a component in the fuel system resulting in an alteration of the fuel flow and/or pressure as a function of temperature.

Figure 1A:
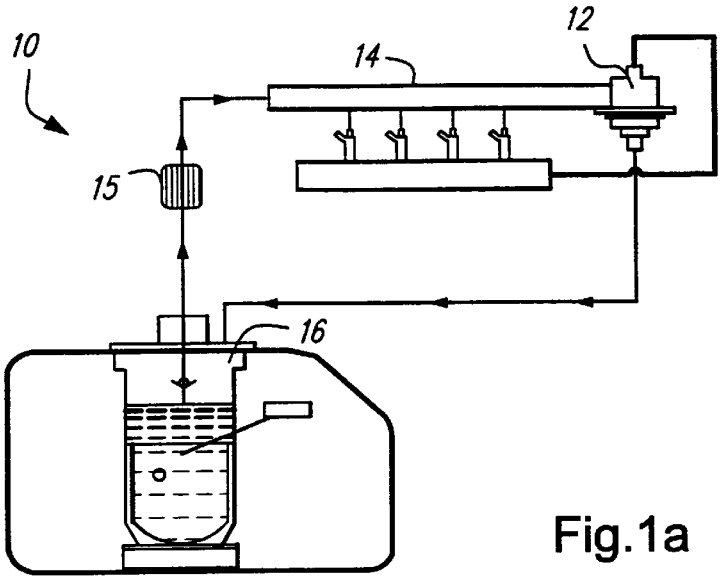
FIGS. 1*a*–1*f* are schematic diagrams of conventional fuel systems.
Figure 1B:
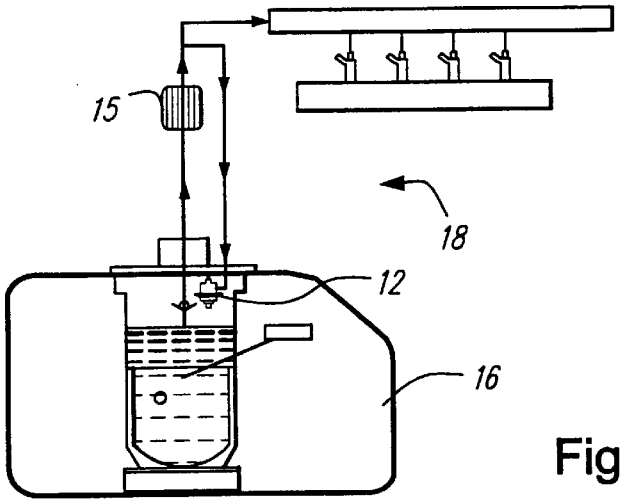
Figure 1C:
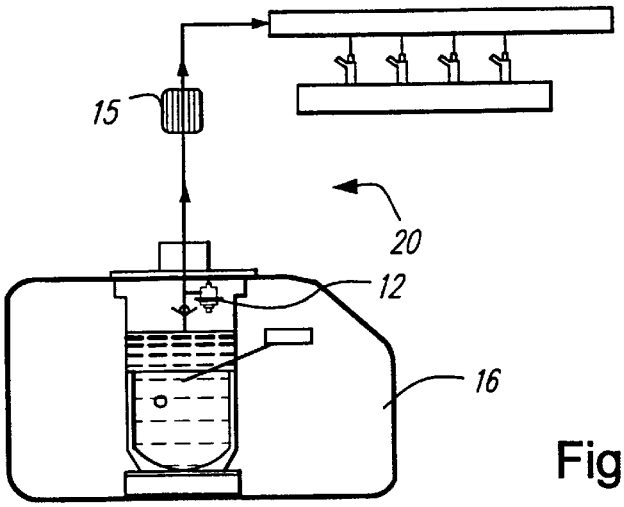
Figure 1D:
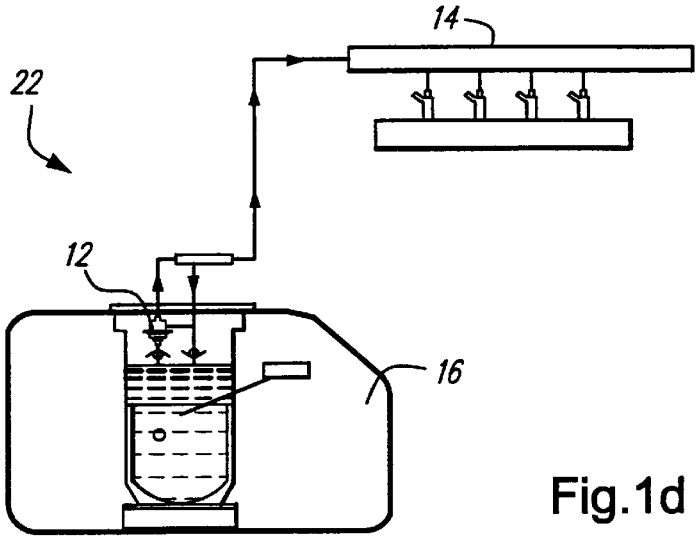
Figure 1E:
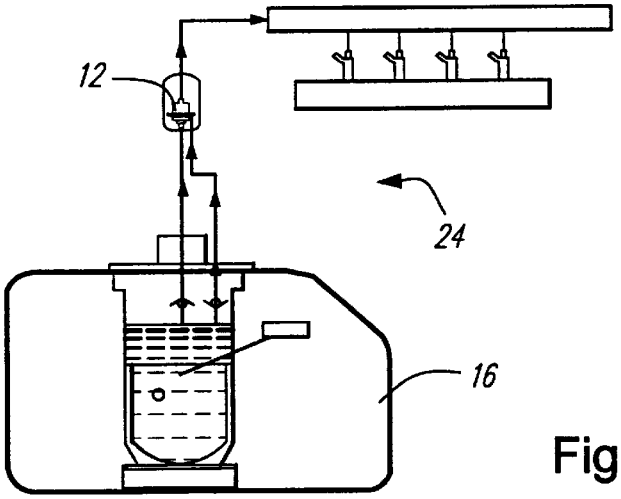
Figure 1F:
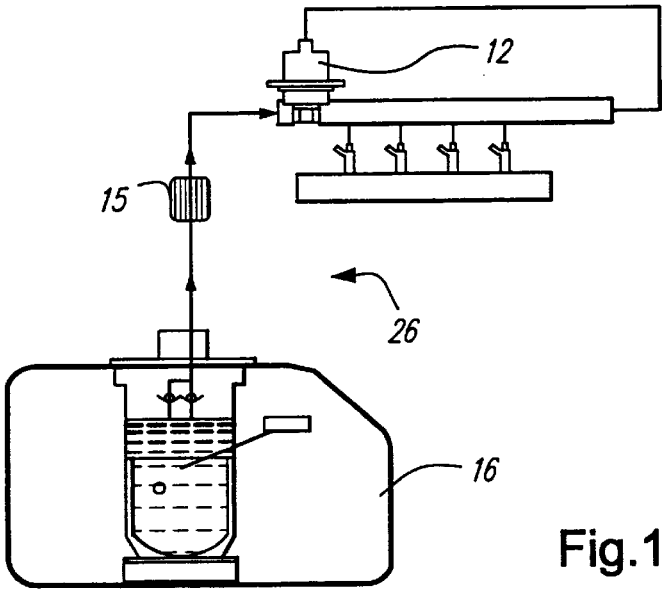

Referring to FIGS. 1*a*–1*f*, various fuel systems are illustrated. FIG. 1*a* shows a conventional return fuel system 10 having a pressure regulator 12 disposed adjacent the fuel rail 14 and returning unburned fuel to a fuel tank 16. Fuel is filtered by filter 15. FIG. 1*b* shows a fuel system 18 having no return, and the pressure regulator 12 is disposed within the fuel tank 16, and all pump supplied fuel is filtered. FIG. 1*c* illustrates a fuel system 20, similar to the system 18 shown in FIG. 1*b*, having no return and the pressure regulator 12 located within the fuel tank 16, however, only engine consumed fuel is filtered. The system 22 shown in FIG. 1*d* is a no return system having a combined regulator and filter. FIG. 1*e* shows a no return system 24 where the pressure regulator 12 and filter 15 are combined and positioned remotely from the fuel tank 16. Finally FIG. 1*f* shows a no return system 26 having a demand regulator system in which fuel from the tank 16 is feed through the filter 15 to the regulator 16. The regulator is connected to the fuel rail 14 and to the far side of the fuel injectors 28.

If a component of the fuel system is constructed of shape memory alloy the performance of the component and therefore the performance of the entire fuel system can be improved. Performance, as far as the present application is concerned, is defined to mean a reduction in emissions, an increase in fuel economy, an increase in horse power, an increase in component life or a combination thereof.

Figure 2B:
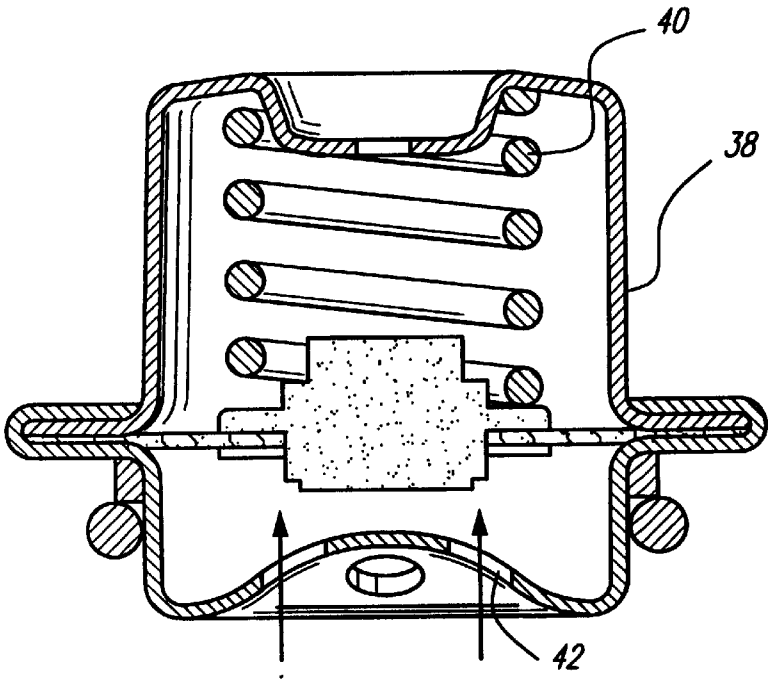
FIGS. 2*a*–2*d* are cross-sectional views of returnless fuel systems.
Figure 2A:
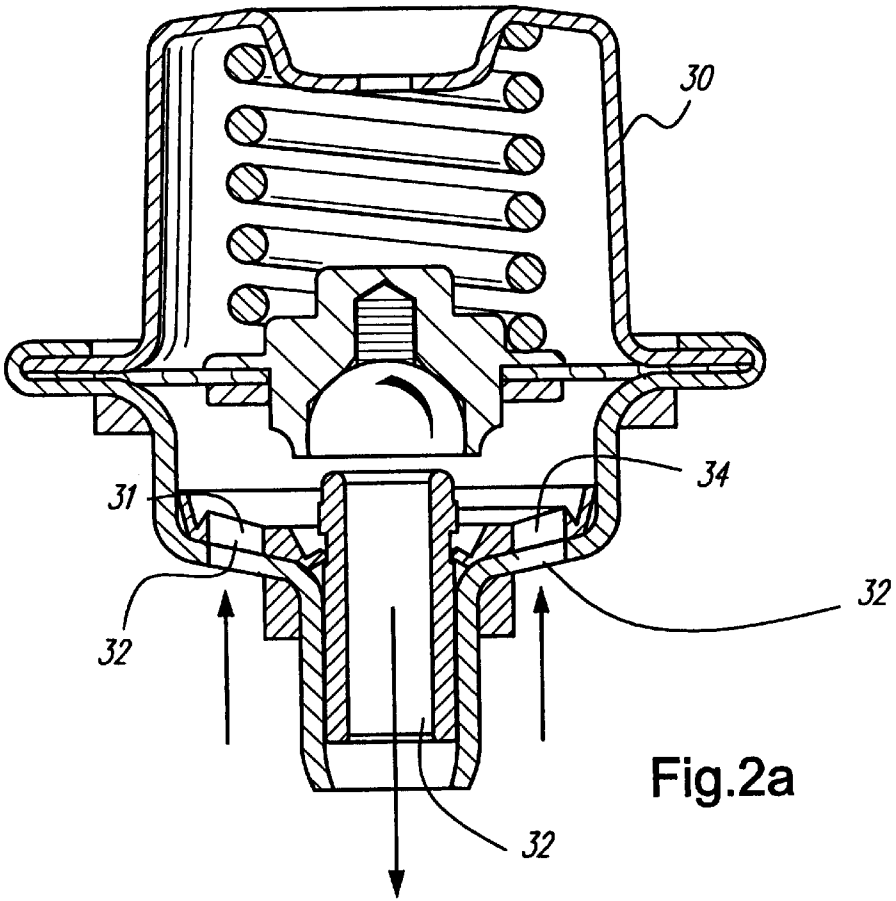
Figure 2D:
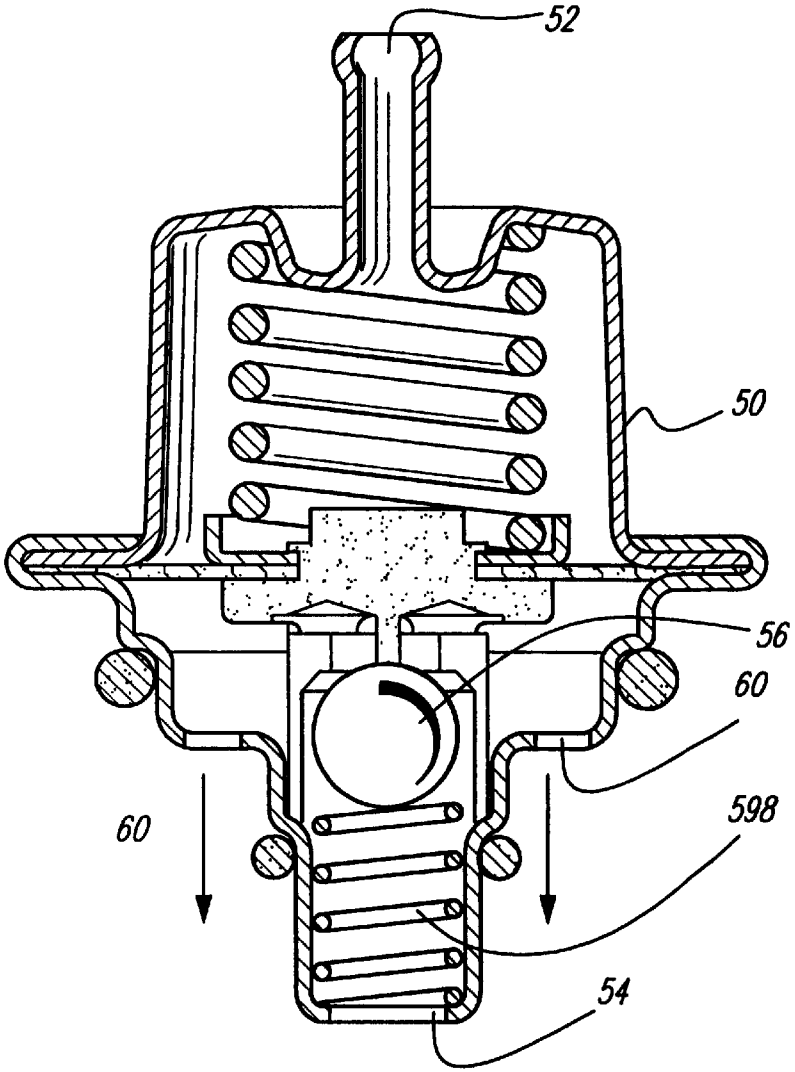

In a returnless regulator such as shown in FIG. 2*d*, a small biasing spring is provided. This biasing spring can be made from shape memory alloy thereby providing the fuel system with multiple pressure levels. The foregoing can be achieved during a hot soak condition. During a hot soak, the temperature of the component and/or the fuel will exceed a pre-specified value, for example 60 degrees Centigrade. The shape memory bias spring will therefor change form, causing the ball to stay open for a time period until the temperature is reduced in the fuel system below the pre-specified point. As a result, the system operates at two levels thereby preventing the fuel from vaporizing.

Referring to FIGS. 2*a*–2*d*, various returnless or non-return regulators are shown in cross-section. In the regulator shown in FIG. 2*a*, an integral regulator 30 is shown where fuel flows through inlets 32 against biased spring 34, and flows out through outlet 36.

Figure 2C:
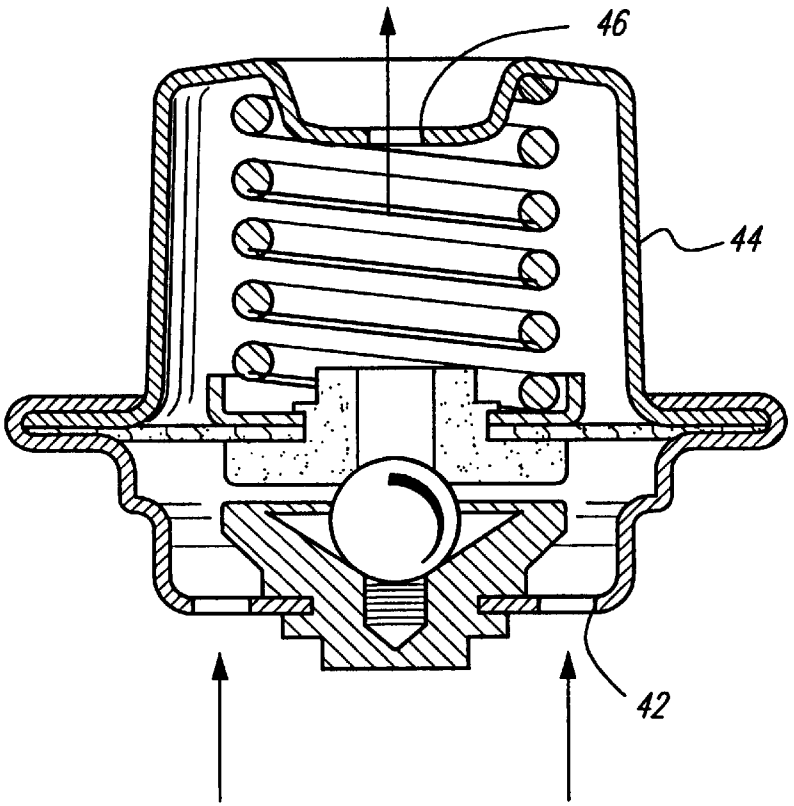

FIG. 2*b* represents an integral damper 38 and has a bias spring 40. The fuel flows through the inlets 42. Similarly in FIG. 2*c* the fuel flow in through inlets 42, however, instead of a damper, FIG. 2*c* represents a flow through regulator 44, and has an outlet 46 on a side opposite the inlets 42. FIG. 2*d* shows an integral returnless "demand" regulator 50. A manifold reference is connected through port 52. Fuel flows in through an inlet 54 against a ball 56 biased by a spring 58 and out through outlets 60. The integral returnless "demand" regulator 50 shown in FIG. 2*d* dampens pressure pulsations and/or can isolate engine vibrations.

Figure 3C:
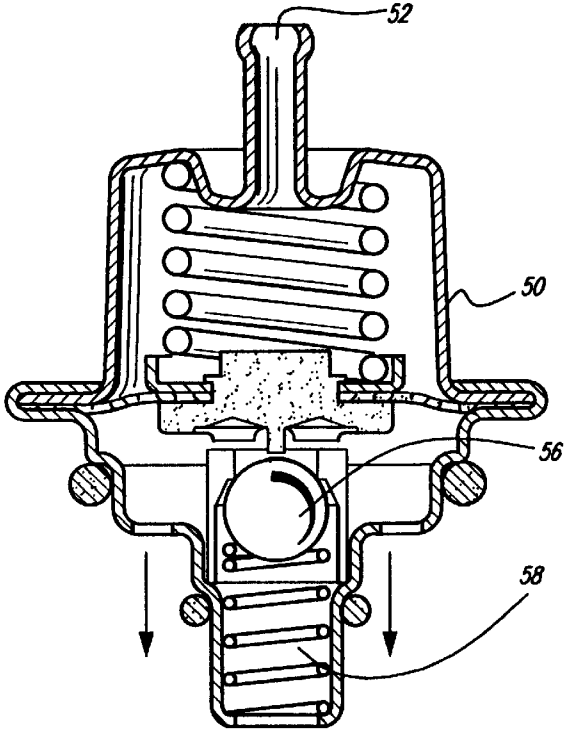
FIGS. 3*a*–3*c* are cross-sectional views of an integral returnless pressure regulator having a spring made from shape memory alloy according to the present invention.
Figure 3B:
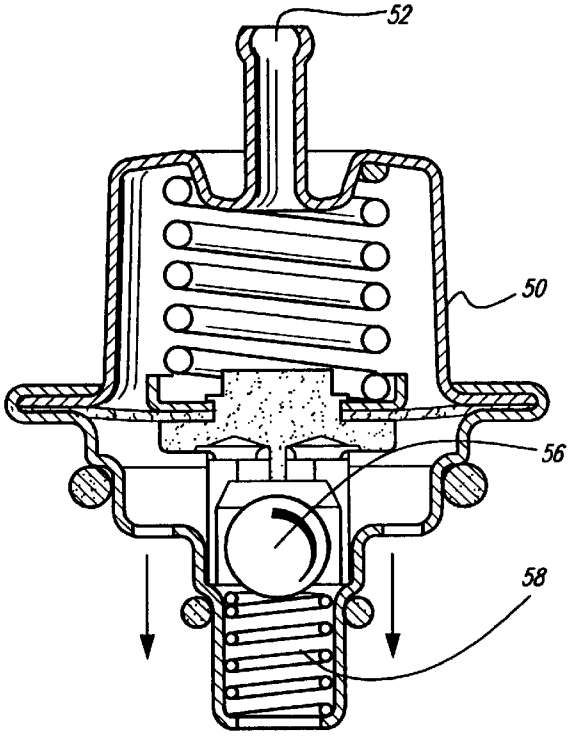
Figure 3A:
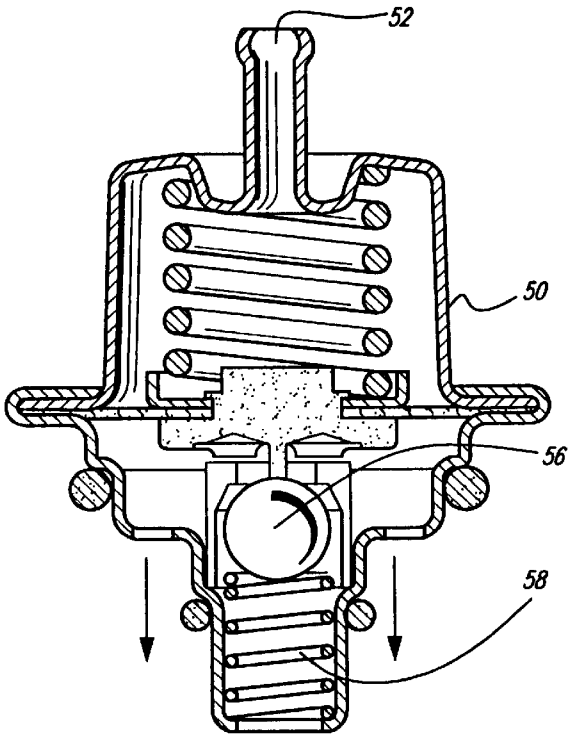

Referring to FIGS. 3*a*–3*c*, three operating stages of the integral returnless "demand" pressure regulator 50 are shown. In FIG. 3*a*, a general operating mode is shown where the ball 56 is biased by the spring 58, made from a shape memory alloy such as titanium-nickel based alloy or copper based alloy. The regulator 50 is operating at a predefined operating pressure, and the valve is either open or closed depending upon the fuel pressure.

In FIG. 3*b*, the engine is off and the integral returnless "demand" pressure regulator 50 is at low pressure, and therefore the valve is open. When the integral returnless "demand" pressure regulator 50 is in the hot soak mode, shown in FIG. 3*c*, the pressure is raised to prevent fuel vaporization and the valve is closed.

During the hot soak mode, the temperature of the bias spring 58 and/or the fuel will exceed a pre-specified value, for example 60 degrees Centigrade. The shape memory bias spring 58 will therefor change form, causing the ball 56 to remain open for until the temperature of the fuel system drops below the pre-specified point. As a result, the integral returnless "demand" pressure regulator 50 operates at two levels thereby preventing the fuel from vaporizing.

Figure 4:
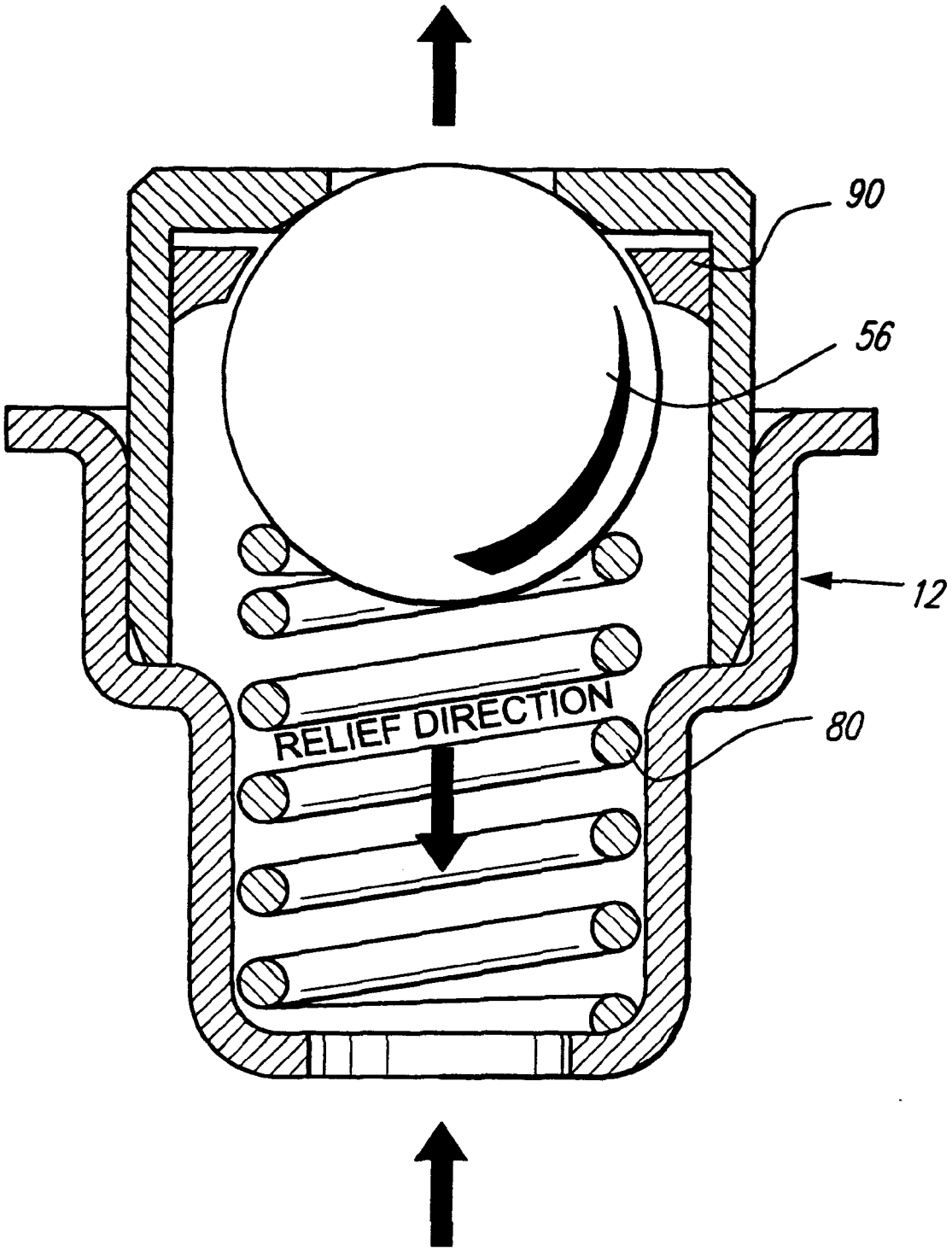
FIG. 4 is a cross-sectional view of a second configuration of shape memory alloy spring in a returnless regulator according to the present invention.

FIG. 4 shows a cross-sectional view of a second configuration of shape memory alloy spring in a returnless regulator. In this embodiment, the ball 56 of the pressure regulator 12 is biased by the spring 80 in the flow direction against a washer 90, located adjacent the exit orifice. The washer 90 is made from shape memory alloy. In the is illustrated embodiment the force on the ball 56 is approximately 6 Newtons or 1.3 lbs. The ball 56 has a diameter of approximately 0.28". The spring 80 has a height of approximately 4.75 mm or 0.187", and the outer diameter of the spring wire is 0.56 mm or 0.022". The spring 80 has an outer coil diameter of 6.0 mm or 0.24".

While the foregoing description referred to the drawings with regard to fuel flow, the invention and the drawings are equally applicable to an air flow context.

Having described an embodiment of the fuel system containing a shape memory alloy in accordance with the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A no-return demand pressure regulator for a fuel system comprising:

a housing having a diaphragm defining an air chamber and a fuel chamber in the housing;

the air chamber being connected to an air manifold;

the fuel chamber having an inlet connected to a fuel supply and an outlet connected to a fuel rail, a valve disposed between the fuel chamber inlet and the diaphragm; and a biasing spring disposed between the fuel chamber inlet and the valve, the biasing spring being made of a temperature-sensitive shape memory alloy; wherein when the biasing spring reaches a set temperature the biasing spring changes form and closes the valve thereby shutting off fuel flow through the fuel inlet.

2. The no-return demand pressure regulator of claim 1 wherein the set temperature is about 60 degrees Centigrade.

3. The no-return demand pressure regulator of claim 1 wherein the temperature-sensitive shape memory alloy is one of titanium-nickel based alloy and copper based alloy.

4. A no-return fuel system comprising;

a fuel tank, a fuel pump for pumping fuel from the fuel tank;

a no-return demand pressure regulator having a fuel inlet for receiving fuel from the fuel pump;

a fuel rail for receiving fuel from a fuel outlet of the no-return demand pressure regulator;

at least one fuel injector connected to the fuel rail;

the no-return demand pressure regulator including a valve biased by a spring made from a temperature-sensitive shape memory alloy; wherein when the spring reaches a set temperature the spring changes form and closes the valve thereby shutting off fuel flow through the fuel inlet.

5. The no-return fuel system of claim 4 wherein the set temperature is about 60 degrees Centigrade.

6. The no-return fuel system of claim 4 wherein the temperature-sensitive shape memory alloy is one of titanium-nickel based alloy and copper based alloy.

* * * * *